US005746639A

United States Patent [19]

Bloom et al.

[11] Patent Number: 5,746,639

[45] Date of Patent: May 5, 1998

[54] FLAT STUFFED DOLL AND CLOTHING COMBINATION

[75] Inventors: Stuart J. Bloom, Concord; Lorna Nichols, Stowe, both of Mass.

[73] Assignee: Pockets of Learning, Ltd., Sudbury, Mass.

[21] Appl. No.: 425,286

[22] Filed: Apr. 20, 1995

Related U.S. Application Data

[63] Continuation-in-part of Ser. No. 169,166, Dec. 17, 1993, abandoned, which is a continuation-in-part of Ser. No. 993,306, Dec. 18, 1992, abandoned.

[51] Int. Cl.[6] ..... A63H 3/08; A63H 3/02

[52] U.S. Cl. ..... 446/98; 446/369

[58] Field of Search ..... 446/98, 369, 901, 446/394, 321; 112/439, 266.1

[56] References Cited

U.S. PATENT DOCUMENTS

| | | | |
|---|---|---|---|
| 2,331,776 | 10/1943 | Heggedal | 446/98 |
| 3,771,479 | 11/1973 | Mavis | 112/266 |
| 3,855,730 | 12/1974 | Baer . | |
| 4,122,628 | 10/1978 | Crowell et al. | 446/98 X |
| 4,244,996 | 1/1981 | Maloney | 428/103 |
| 4,373,292 | 2/1983 | Pelura | 446/321 X |
| 4,911,670 | 3/1990 | McNicholas et al. | 446/74 |
| 4,925,423 | 5/1990 | Miller et al. | 446/98 |
| 5,005,219 | 4/1991 | Diaz | 2/244 |
| 5,099,773 | 3/1992 | Codos | 112/266.1 |
| 5,299,968 | 4/1994 | Bennett | 446/394 |

*Primary Examiner*—Mickey Yu

*Attorney, Agent, or Firm*—Hamilton, Brook, Smith & Reynolds, P.C.

[57] ABSTRACT

A stuffed doll and clothing combination includes a three-dimensional doll body having a front and rear surface made from a soft material enclosed by a fabric cover. Attachment means of a first component of hook and fastener material are located on the front surface of the doll body representing articles of clothing including underwear and wristbands. Flat clothes adapted to attach to the front surface of the doll body have fastening means of a second component of hook and loop fastener material for joining the clothes to at least a portion of the attachment means. The clothes include a backing material and a base fabric affixed to the backing material. The base fabric has at least two regions with at least one region colored by a fabric printing process. The border of the colored region is embroidered such that the colored region has the appearance of being made of a different fabric than the base fabric. The front surface of the doll can include features of a first doll while the rear surface can include features of a second doll.

9 Claims, 5 Drawing Sheets

FLAT STUFFED DOLL AND CLOTHING COMBINATION

RELATED APPLICATION

This application is a continuation-in-part of U.S. patent application Ser. No. 08/169,166, filed on Dec. 17, 1993 which is a continuation-in-part of U.S. patent application Ser. No. 07/993,306, filed on Dec. 18, 1992.

BACKGROUND OF THE INVENTION

The present invention relates generally to dolls, and more particularly, to a doll and clothing combination.

Dolls which a child can dress are popular. Currently, there are three-dimensional dolls having appropriately scaled clothing, and two-dimensional dolls such as paper dolls to which two-dimensional clothing facades may be applied. While three-dimensional dolls may be inexpensive to manufacture, scaled-down clothing is relatively expensive to manufacture, making it costly to provide an extensive wardrobe for such a doll. Although paper dolls are inexpensive and their clothing is simple and inexpensive to manufacture, they are not as durable or as attractive to play with as stuffed dolls covered with fabric.

SUMMARY OF THE INVENTION

The present invention provides a generally two-dimensional doll which is easy to store, easy to manufacture, easy to make clothes for, easy to attach articles of clothing to, and have a greater attractiveness than other types of two-dimensional dolls.

In accordance with one embodiment of the present invention, there is provided a stuffed doll and clothing combination. The doll is three-dimensional, having a front surface and rear surface made from a soft material enclosed by a fabric cover. The doll body is dimensioned to have a relatively substantial height and width but with relatively small depth giving the appearance of a two-dimensional figure. The doll body has a plurality of attachment means located on its front surface. In a preferred embodiment, the attachment means are appliques of loop fabric sewn on various parts of the doll body such as the head, torso, arms and legs of the doll body. Also, there are a plurality of flat clothes adapted to attach to the doll body. The clothes each have a plurality of fastening means located on its rear surface. In a preferred embodiment, the fastening means are tabs of hook fastener material that fasten to the appliques of loop fabric.

In one preferred embodiment, the front surface of the doll body includes features of a first doll and the rear surface of the doll body includes features of a second doll. The first doll features are female and the second doll features are male. A plurality of attachment means are also included on the rear surface of the doll body. A cover adapted to attach to the doll body for covering one of the surfaces of the doll body includes fastening means for joining the cover to the attachment means on the front or rear surface of the doll body.

In one preferred embodiment, the clothing for the doll include a backing material and a base fabric affixed to the backing material. The base fabric has at least two regions. At least one region is colored by a fabric printing process. The border of the colored region is embroidered such that the colored region has the appearance of being made from a different fabric than the base fabric. Hook fastener material is affixed to the backing material so that the clothes can be secured to the doll body.

The present invention includes features which can be applied to U.S. patent application Ser. No. 08/090,249, filed Jul. 9, 1993, which is incorporated herein by reference.

While the present invention will hereinafter be described in connection with a preferred embodiment, it will be understood that it is not intended to limit the invention to these embodiments. Instead, it is intended to cover all alternatives, modifications and equivalents as may be included within the spirit and scope of the present invention as defined by the appended claims.

DETAILED DESCRIPTION OF THE INVENTION

Figure 2:
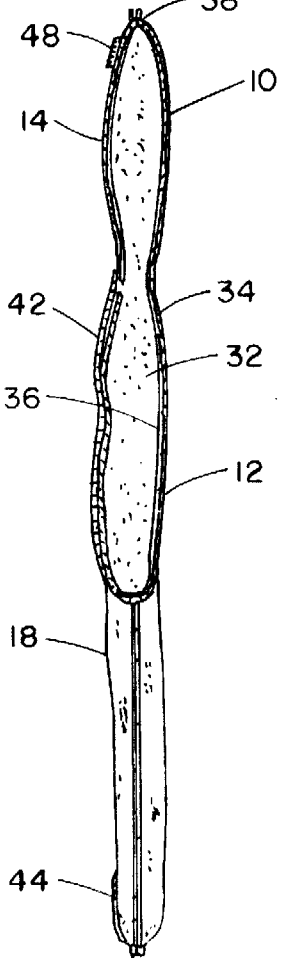
FIG. 2 is a vertical section taken generally along the line 2—2 of FIG. 1.
Figure 5:
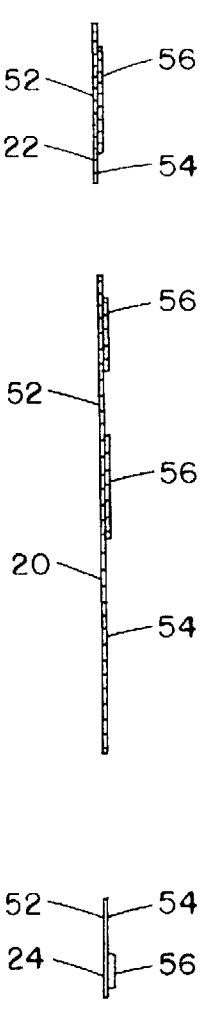
FIG. 5 is a vertical section taken generally along line 5—5 of FIG. 3.
Figure 4:
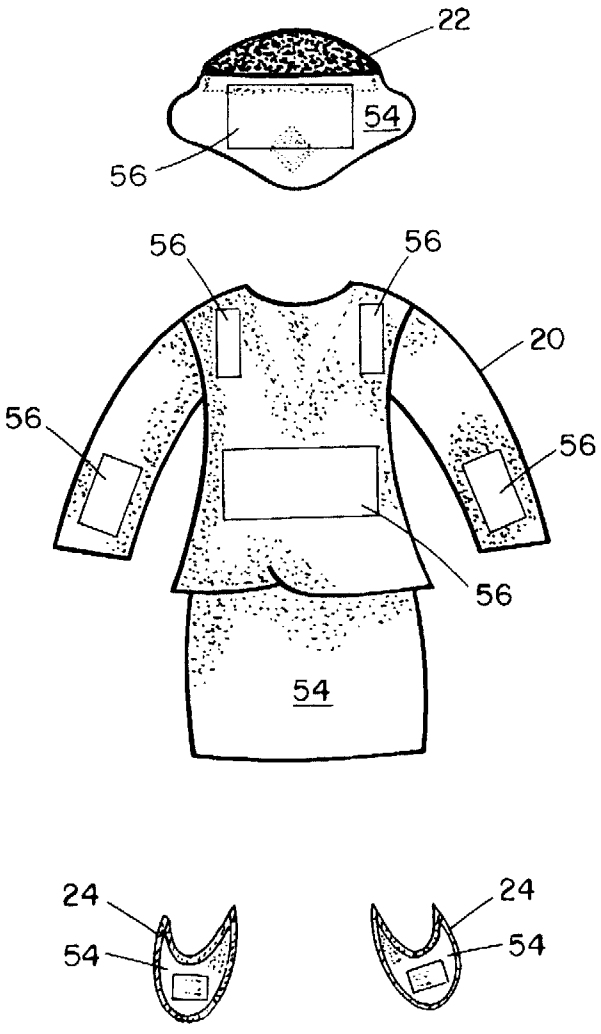
FIG. 4 is a rear elevational view of the set of clothing of FIG. 3.
Figure 3:
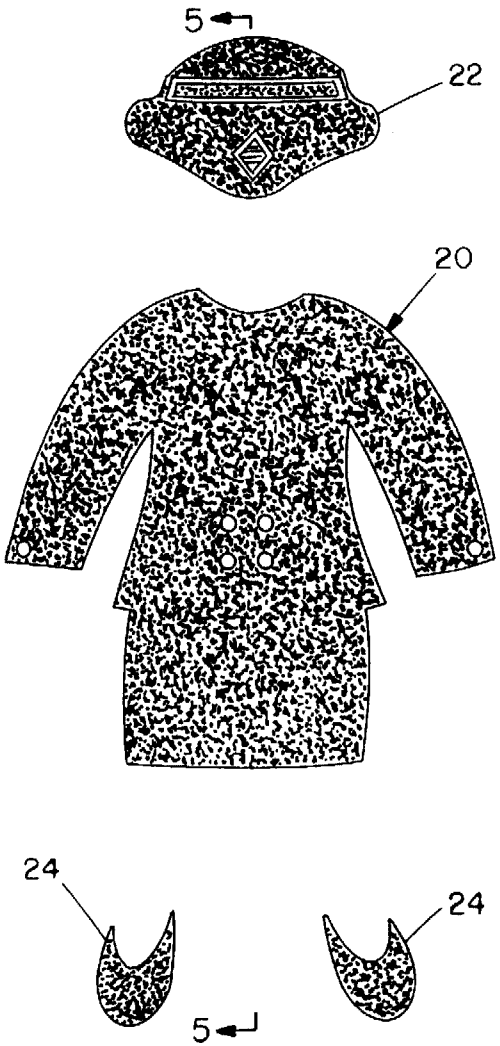
FIG. 3 is a front elevational view of an exemplary set of clothing which is adapted to be fitted on the doll.

The doll combination of the present invention is shown as comprising a doll body, generally designated by reference numeral 10 (see FIGS. 1 and 2) and articles of clothing 20, 22, 24, an exemplary set of which is illustrated in FIGS. 3, 4 and 5.

Figure 1:
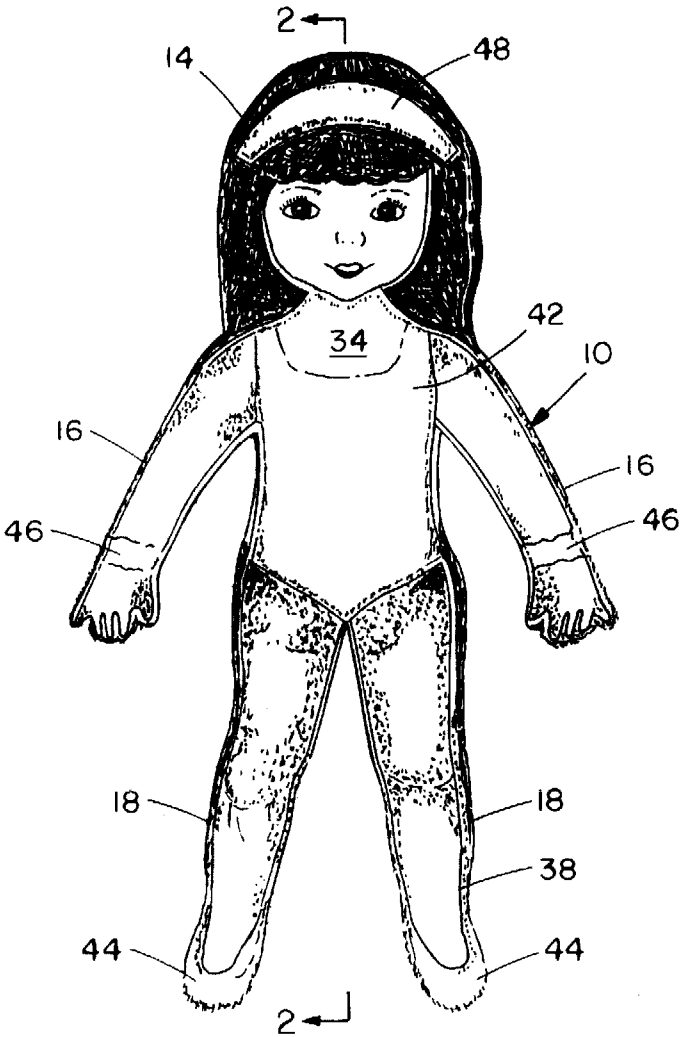
FIG. 1 is a front elevational view showing the doll of the present invention.

FIG. 1 shows the doll body 10 with a front and rear surface having a torso portion 12, with a head 14, arms 16 and legs 18 attached thereto.

FIG. 2 shows the body 10 stuffed with a resilient material 32 such as cotton, polyester fiber, foam, or the like, enclosed by a fabric cover 34. To provide stiffness to the doll figure, a layer of fibrous backing material 36 such as Pellon® or the like may be interposed between the stuffing material 32 and the fabric cover 34. As seen in FIGS. 1 and 2, the amount of stuffing 32 and the dimensions of the cover 34 are such that the doll body 10 has normally proportioned height and width, but relatively shallow depth. The fabric cover 34 and backing material 36 are sewn around the periphery of the doll as at 38. This makes the doll easy and inexpensive to manufacture. In a preferred embodiment, fabric pieces representing articles of clothing such as underwear 42, socks 44, wrist bands 46 and head band 48 are permanently sewn to the doll. The fabric pieces 42, 44, 46 and 48 are made of "looped" applique fabric, such as jersey material, to which a hook portion of "hook and loop" fastener materials, such as Velcro®, will adhere.

FIG. 3 shows an exemplary clothing set comprising suit 20, hat 22, and shoes 24. As shown in FIG. 4, in a preferred embodiment, such clothing articles are constructed of a front layer of fabric 52 sewn to backing material 54, which may consist of a non-woven backing material such as Pellon® which is flexible, but will inhibit fabric 52 from wrinkling or folding. As illustrated in FIGS. 4 and 5, tabs of hook fastener material 56, such as hook Velcro®, are sewn at points on the rear of clothing articles 20, 22 and 24 which lie opposite respective loop pieces 42, 44, 46 and 48 on doll 10 when the clothing articles are placed in their proper positions.

Figure 7:
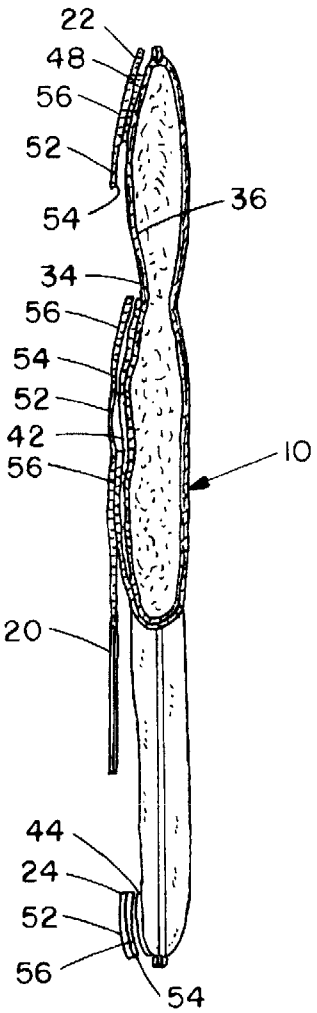
FIG. 7 is a vertical section taken generally along line 7—7 of FIG. 6.
Figure 6:
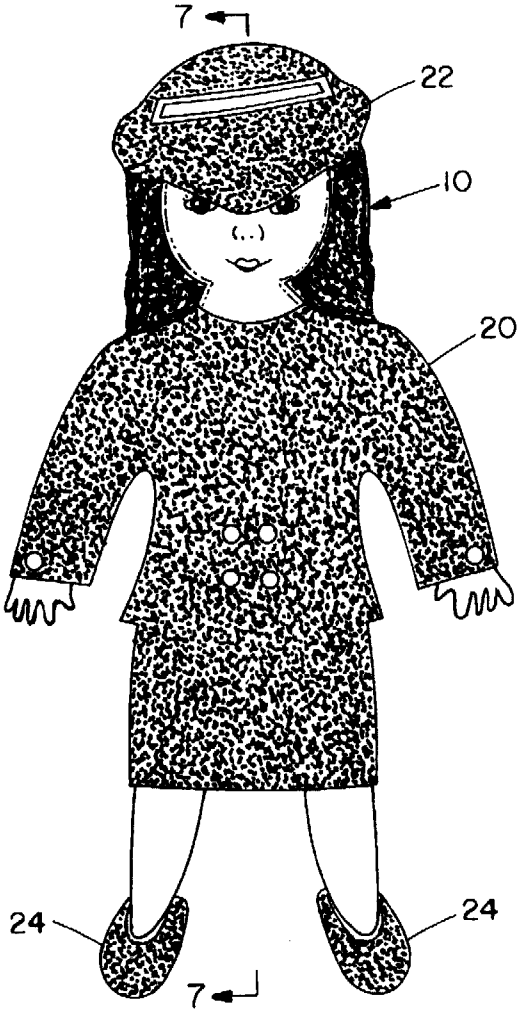
FIG. 6 is a front elevational view of the clothing set of FIG. 3 attached to the doll of FIG. 1.

As shown in FIGS. 6 and 7, by placing the clothing articles 20, 22 or 24 over their appropriate locations on doll 10 and pressing into place, the clothing articles may be readily attached by engaging hook fastener tabs 56 over the appropriate loop appliques 42, 44, 46 and 48.

As the two-dimensional clothing articles and their means of attachment are easily cut and sewn, they are inexpensive to manufacture. The hook-and-loop fasteners do not require accurate positioning or tying of string and the like, thus facilitating attachment of clothing by small children. Unlike paper dolls or other two-dimensional fabric doll combinations in which the clothing articles simply hang from the doll body and are easily displaced, the hook-and-loop fasteners provide a tenacious attachment, and permit attachment of clothing articles such as shoes and gloves which are difficult to attach by other methods.

Figure 9:
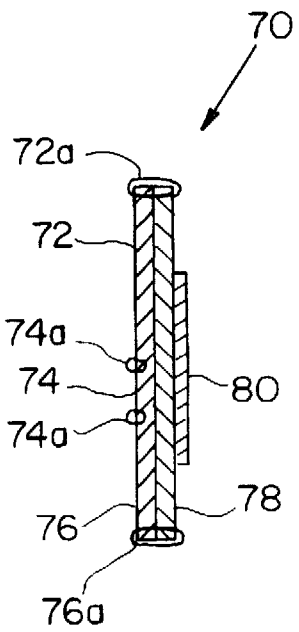
FIG. 9 is a side sectional view of the hat depicted in FIG. 8.
Figure 8:
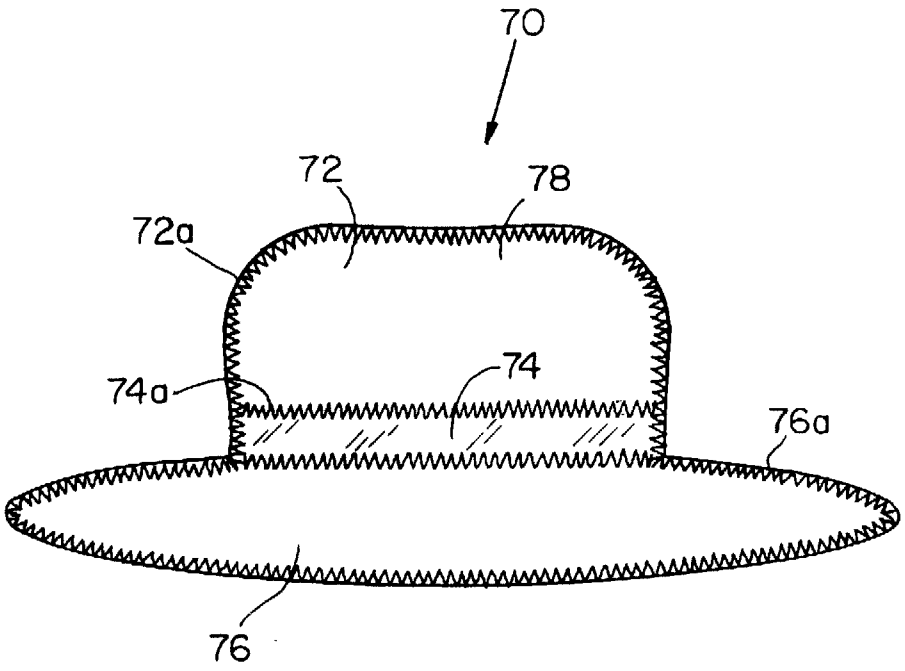
FIG. 8 is a front elevational view of a hat.

FIGS. 8 and 9 depict a hat 70 made by a preferred manufacturing method. The manufacturing method of the present invention provides an inexpensive construction of clothing which gives the appearance of applique clothing. By "applique", it is meant that a piece of one fabric is laid over a larger piece of another fabric of different color, pattern or texture. Often, the border of the first fabric is stitched to the underlying fabric with a decorative stitch or embroidery stitch. Such applique ornamentation is labor intensive, involves skilled labor, and requires more expensive materials, consequently resulting in a higher cost of production.

In the present invention manufacturing method, the doll's clothing articles are constructed so as to give the appearance of more costly applique ornamentation without requiring the application of fabric pieces, thereby lowering manufacturing costs.

Hat 70 includes a base fabric 72 and a backing material 78. Backing material 78 is made of the same material as backing material 54 (FIGS. 4 and 5). Hook fastener material 80 is affixed to backing material 78 for fastening hat 70 to the head 14 of the doll. Hook fastener material 80 can be sewn to backing material 78 or secured by an adhesive.

Hat-band 74 is printed a different color than base fabric 72 by a fabric printing process such as silk screening. The printed hat-band 74 is outlined by embroidery stitches **74*a*. This gives hat-band 74 the appearance being made from a different fabric than the top region 78 which is made of base fabric 72. The top region 78 of hat 70 remains unprinted and is bordered by embroidery stitches 72*a*. Additionally, the brim 76 is printed with a different color than hat-band 74 by the fabric printing process. The brim 76 is outlined by embroidery stitches 76*a*. This gives brim 76 the appearance of being made from a different fabric than either top region 78 or hat-band 74. The printing of hat-band 74 and brim 76 gives the appearance of appliques applied to base fabric 72 once the edges are covered by embroidery stitches. As a result, the embroidered colored regions form false appliques on base fabric 72**.

Although FIGS. 8 and 9 are directed towards a hat, the same method of making clothes can be applied to more complicated articles of clothing such as a dress or a coat. For example, the set of clothes depicted in FIGS. 3, 4 and 5 can be manufactured in this manner. In such articles of clothing, several false appliques may be employed involving different colors and shapes, some of which may be of a small size which would be difficult to cut and apply as a real applique. The embroidery stitching which borders the false appliques is easier to sew than a real applique because the stitches only need to go through a single layer of cloth. Additionally, it is not necessary to enclose any loose threads by the stitching as is the case with real appliques. The present invention method of making clothes may also be employed in the construction of the features of the doll itself, such as for eyes and lips.

Figure 10:
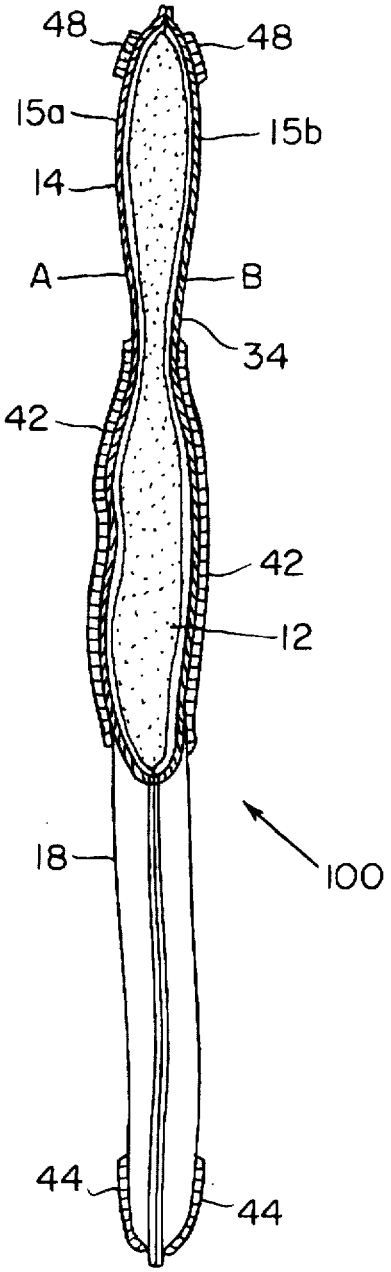
FIG. 10 is a side sectional view of another preferred doll.

FIG. 10 depicts another preferred embodiment of the present invention. Doll body 100 is similar to doll body 10 differing in that doll body 100 has two sides A and B both depicting frontal features of a doll. Side A includes the frontal features and face **15*a* of one doll while side B includes the frontal features and face 15*b* of another doll. This allows the doll to be two different dolls, if desired. As on side A, side B includes "looped" fabric pieces 42, 44, 46 and 48 for attaching clothing articles to side B. Face 15*b* can be the same face as 15*a* but with a different facial expression or can be a face of a different person. In one embodiment, face 15*b* is the face of a male while face 15*a* is a face of a female. When face 15*b* is a face of a male, fabric pieces 42, 44, 46 and 48** are articles of male clothing.

Figure 11:
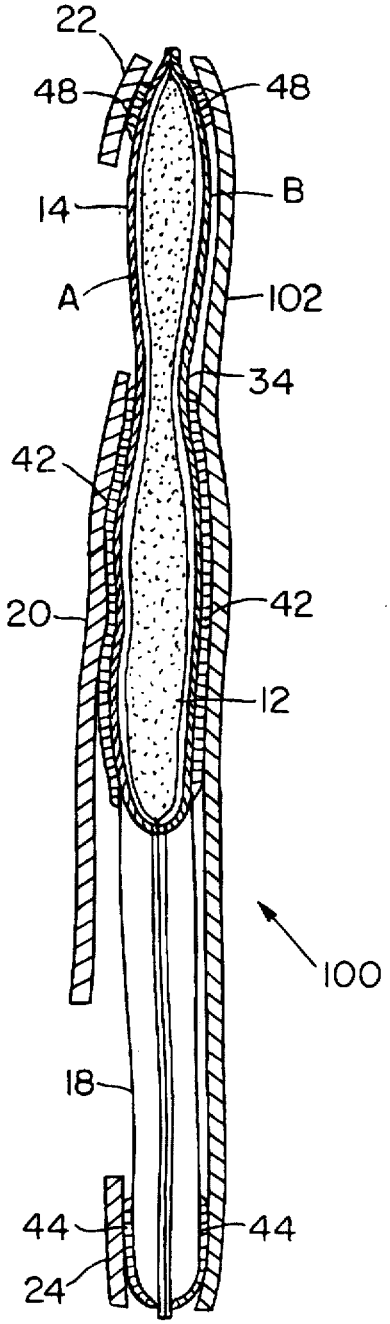
FIG. 11 is a side sectional view of the doll in FIG. 10 with clothing attached to the doll.

In use, one side of the doll is typically used at one time. For example, as depicted in FIG. 11, articles of clothing 20, 22 and 24 are attached to the doll body 100 on side A. A cover 102 having the outline of doll body 100 is attached to side B to hide the features on side B so that only the frontal features of side A can be seen. When the user desires to play with the doll of side B, the clothes are moved from side A to side B and the cover 102 is moved from side B to side A. Alternatively, articles of clothing can be attached simultaneously to both sides A and B if the user desires to play with a doll having two faces.

While the invention has been particularly shown and described with reference to a preferred embodiment thereof, it will be understood to those skilled in the art that various changes in form and details may be made therein without departing from the spirit and scope of the invention as defined by the appended claims.

We claim:

1. A stuffed doll and clothing combination comprising:

a 3-dimensional doll body having a front and rear surface made from a soft material enclosed by a fabric cover;

attachment means of a first component of hook and loop fastener material located on the front surface of said doll body representing articles of clothing including underwear and wristbands;

flat clothes adapted to attach to the front surface of said doll body, the clothes having fastening means of a second component of hook and loop fastener material for joining the clothes to at least a portion of the attachment means.

2. A stuffed doll according to claim 1 in which the clothes comprise:

a backing material; and a base fabric affixed to the backing material, the base fabric having at least two regions, at least one region colored by a fabric printing process, the border of the colored region being embroidered such that the colored region has the appearance of being made of a different fabric than the base fabric.

3. A stuffed doll according to claim 1 wherein the front surface of the doll includes features of a first doll and the rear surface includes features of a second doll.

4. A stuffed doll according to claim 1, wherein the fastening means are tabs of hook fastener material.

5. A stuffed doll according to claim 1, wherein the attachment means are appliques of loop fabric.

6. A stuffed doll according to claim 5, wherein the appliques of loop fabric are sewn to the doll body.

7. A stuffed doll according to claim 1, wherein the soft material is selected from a group comprising cotton, polyester fiber or foam.

8. A stuffed doll according to claim 7, further including a layer of fibrous backing material interposed between the soft material and the fabric cover.

9. A stuffed doll according to claim 1, wherein the fastening means are tabs of hook fastener material which are sewn in back of the clothes.

* * * * *